United States Patent [19]

Reeves

[11] 3,990,342

[45] Nov. 9, 1976

[54] PISTON VALVE TYPE MUSICAL INSTRUMENT AND METHOD THEREFOR

[76] Inventor: Robert S. Reeves, 711 N. Ridgeway Place, Hollywood, Calif. 90038

[22] Filed: July 14, 1975

[21] Appl. No.: 595,279

[52] U.S. Cl. ..... 84/392
[51] Int. Cl.[2] ..... G10D 9/04
[58] Field of Search ..... 84/385–394

[56] References Cited

UNITED STATES PATENTS

| | | | |
|---|---|---|---|
| 911,637 | 2/1909 | Adkins | 84/393 |
| 1,367,386 | 2/1921 | Hawkins | 84/392 |
| 2,149,714 | 3/1939 | Wornell | 84/392 X |
| 2,511,255 | 6/1950 | George | 84/392 |

*Primary Examiner*—Lawrence R. Franklin
*Attorney, Agent, or Firm*—Flehr, Hohbach, Test, Albritton & Herbert

[57] ABSTRACT

A piston valve type instrument has mechanical means for continuous adjustment of the upstroke and downstroke of the valves which provides for improved playing response. In addition, a method of improving the response utilizing such continuous adjustment includes deliberately introducing a misalignment of the valve ports if the playing response so indicates.

5 Claims, 4 Drawing Figures

PISTON VALVE TYPE MUSICAL INSTRUMENT AND METHOD THEREFOR

BACKGROUND OF THE INVENTION

The present invention is directed to a valve type musical instrument and method therefor and more specifically to an apparatus and method for accurately adjusting the upstroke and downstroke of the valves of the instrument to provide for improved playing response.

In valve type brass instruments such as the trumpet, the length of the air column is increased by tubing switched in by the use of valves. In the case of a piston type valve the upstroke and downstroke of the piston must conform to tolerances of a few thousandths of an inch. Present musical instruments utilize felt pads or pads of other artificial material for both adjusting the upstroke and downstroke and providing for elimination of any metal clicking sound when the instrument's valves are actuated by the player.

Improper alignment of the valve ports in either the upstroke or downstroke positions can result in a rough or "stuffed" playing characteristic of the instrument and also cause faulty intonation.

Improper alignment may result from faulty manufacturing techniques at the factory where an instrument not built perfectly may be set in a compromising position to play at its optimum. Also long use of the instrument may cause the pad to be pounded thin changing alignment. Where this occurs the changing of the felt pads is possible but this is cumbersome and provides only very coarse adjustment. To somewhat compensate for the decrease in thickness, most manufacturers use pads of a larger size (initially resulting in imperfect playing response) assuming the pads will be pounded down to a better position. In any case, new pads may vary 0.003 to 0.005 of an inch from their nominal size.

Yet another difficulty in the adjustment of valve type instruments is that their design is still based on empirical selection of musically desirable forms. Thus, a dimensionally perfect instrument which also has its ports in perfect alignment may not result in the proper playing response.

OBJECTS AND SUMMARY OF THE INVENTION

It is, therefore, an object of the present invention to provide an improved valve type musical instrument and process therefor.

It is another object of the invention to provide an instrument as above which has improved playing response.

It is yet another object of the invention to provide a method for improving the playing response of a valve type instrument as above.

In accordance with the above objects there is provided a valve type musical instrument having movable pistons with a predetermined upstroke and downstroke. Mechanically adjustable means are associated with each of the valves of the instrument for continuous adjustment of the upstroke and downstroke.

In another aspect of the invention there is provided a method for improving the playing response of a valve type musical instrument having at least one valve coupled to the leaderpipe, and to the bell and having a mechanically adjustable means for continuous adjustment of the upstroke and downstroke of the piston of the valve. The method comprises the steps of aligning the upstroke and downstroke of the piston of the valve in substantially exact alignment by use of the mechanically adjustable means and thereafter testing the playing response of the instrument. If the upstroke response is defective, the upstroke of the piston is adjusted to misalign the piston by up to 10/1000 inch. If the downstroke response is defective, the downstroke of the piston is adjusted by misaligning it in the range of 3/1000 to 10/1000 inch.

DETAILED DESCRIPTION OF THE PREFERRED EMBODIMENT

Figure 1:
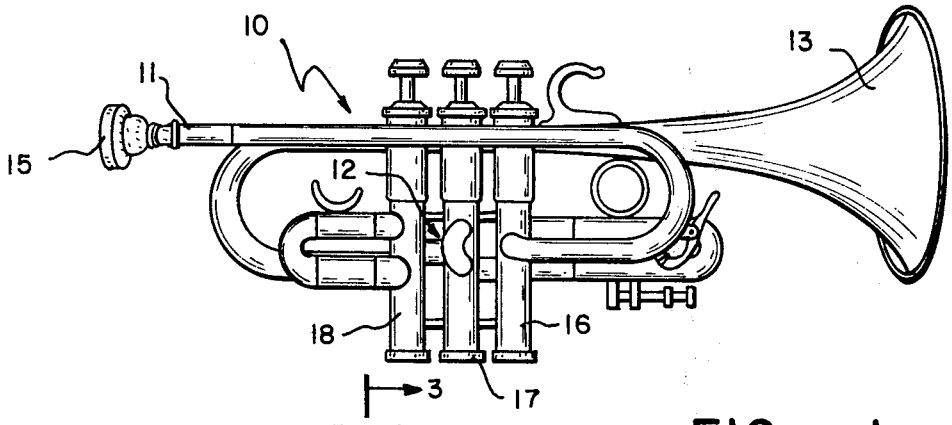
FIG. 1 is a side view of a trumpet embodying the present invention.

FIG. 1 illustrates a trumpet 10 which from an external standpoint is standard in all respects. Generally it includes a tapered leader pipe 11 equipped to receive an upper mouthpiece 15, a central cylindrical portion 12 and a tapered and flared bell 13. The acoustical wave generated in the mouthpiece 15 and sent down the leader pipe 11 first enters the valve 16, passes through the valve 17 and exits at the valve 18 which is coupled to the bell 13. As is well-known in trumpets and other piston valve instruments the common arrangement is that the valve 16 (the "third valve") lowers the intonation by two semitones, the valve 17 (the "second valve") by one semitone, and the valve 18 (the "first valve") by three semitones.

Figure 2:
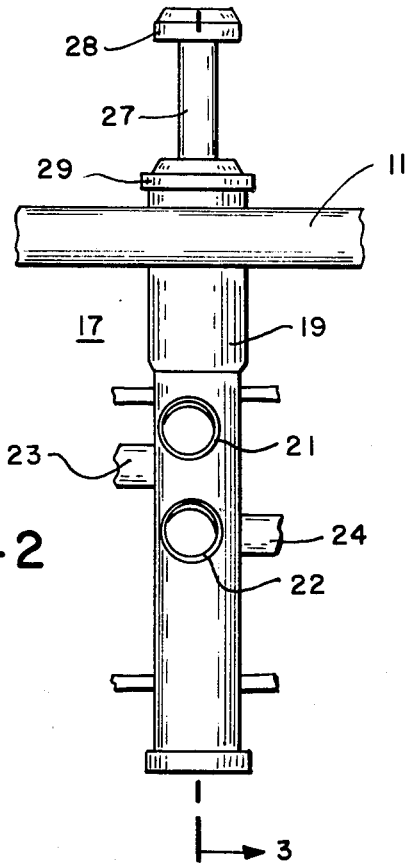
FIG. 2 is an enlarged view of a valve portion of FIG. 1.
Figure 3:
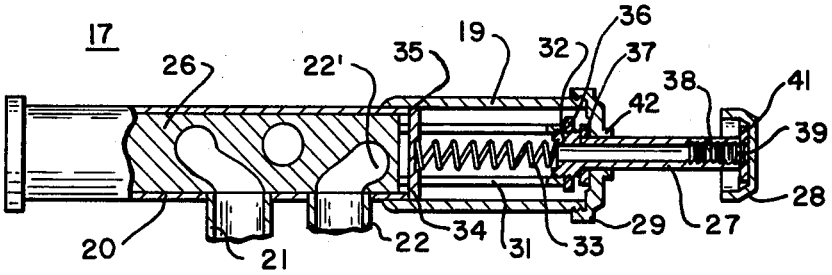
FIG. 3 is a cross-sectional view taken along line 3—3 of FIG. 2.

Referring now to FIGS. 2 and 3 which illustrate the valve 17 in greater detail it includes the outer valve barrel or sleeve 19 sometimes called "the baluster" and the inner sleeve 20 having ports 21 and 22 which are fully illustrated and which accommodate the "second valve" slide, and in addition the transfer ports 23 and 24 with only the transfer tubing as shown extending therefrom. Reciprocating within the inner sleeve 20 is a piston 26 as best shown in FIG. 3 which is shown in its upstroke position and is movable to a downstroke position. Connected to the piston 26 is a stem 27 topped by a button 28 which is engaged by a finger of the player. Piston 26 is threadably retained in the barrel 19 by means of a top cap 29. Extending from the top portion of piston 26 and forming part of it is a cylindrical spring barrel 31 having internally threaded into its upper extremity a top spring retainer 32. This serves the purpose of retaining an internal compression spring 33 which has its innermost end retained by a cross member or valve guide 34 the ends of which are fitted into slots 35 in the inner sleeve 20. Thus, the piston 26 is normally biased by spring 33 in the upstroke position.

As thus far described the valve is standard in the art. However, in accordance with the invention, mechanically adjustable means are associated with each of the valves for continuous adjustment of the upstroke and downstroke. Now referring to both FIGS. 3 and 4 in the case of the upstroke the top spring retainer 32 is fully threaded over its entire length and includes a lock nut 36 which abuts against the end of the spring barrel 31 to securely lock the top spring retainer 32 in any desired position to establish an upstroke abutment plane at the selected location. Because of the threaded nature of both retainer 32 and the internal thread of the spring barrel 31 a continuous adjustment of the abutment plane is possible. A ring shaped felt pad 37 interfaces the top spring retainer 32 with the interior side of the cap 29 which furnishes the other abutment plane to define the end of the piston upstroke. Stem 27 is an integral part of retainer 32 and extends therefrom terminating at the button 28.

It is apparent that rotation of retainer 32 will vary the longitudinal position of piston 26 within the barrel thus adjusting the alignment of the associated ports in the upstroke position. In making the actual adjustment, say to valves 16 and 18, a transfer gauge can be utilized which first measures the distance from the top of the barrel 20 (with cap 29 removed, of course) to one of the ports and then measures the distance between the corresponding port 22', for example, of the piston and the top of the felt pad 37 while the piston is removed.

Figure 4:
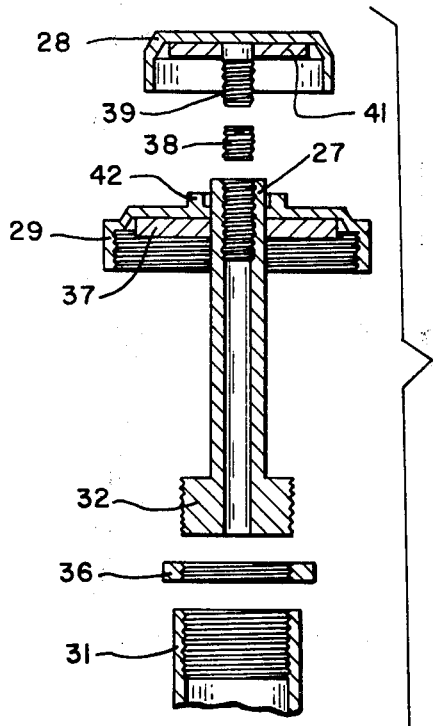
FIG. 4 is an exploded and enlarged cross-sectional view of a portion of FIG. 3.

Downstroke adjustment is provided by internally threading the upper extremity of stem 27 and placing therein a set screw 38. The top of the set screw is slotted as shown in FIG. 4 to provide for adjustment. Button 28 includes a threaded extension 39 which when fitted into the internally threaded stem will abut against set screw 38. Button 28 also includes an internal felt ring 41 which when the piston is fully depressed will abut against the raised ring area 42 of cap 29. Continuous adjustment of downstroke is possible by rotation of set screw 38. In practice this adjustment is accomplished within the barrel 26 by observation of the ports 21 and 22.

In adjusting the port alignment of any valve type instrument for optimum playing response the following method is used.

Initially, the upstroke and downstroke of the pistons of the valves 16, 17 and 18 are aligned so that the ports are in substantially exact alignment. Next the playing response of the instrument is tested. Depending on the type of instrument or the manufacturer and, in fact, the player himself such exact alignment may produce a satisfactory playing response both with respect to resistance and intonation. However, if the response is defective in some manner, the acoustical wave entry piston 16 is misaligned up to .010 inch on its upstroke. This, of course, is accomplished by removing the piston, loosening the lock nut 36 and adjusting the retainer 32. It is believed that the resulting constriction of the acoustical wave path has a critical effect on the playing response of the instrument. After adjustment of the third valve 16 the first and second valves are tested for upstroke playing response. The notes from the bottom of the staff to the top are used on the valve series. A defective responsive is indicated by a lack of fluency in moving from one note to the next.

After the upstrokes are set the second valve is tested in the downstroke position, and then the first and third valves. The above order of testing is for convenience only in that it is easier for the ear to descend chromatically. If the playing response is defective the piston's ports are misaligned in the range of 5/1000 to 10/1000 inch. This is accomplished by removing the button 28 as illustrated in FIGS. 3 and 4 and adjusting set screw 38. The foregoing technique may also be used on a single valve bugle.

In certain instrument constructions the positions of the wave entry and wave exit pistons are reversed. For example, in flugelhorns and high trumpets, the accoustic wave may enter the piston valve nearest the mouthpiece and exit the valve furthest from the mouthpiece. Thus, the wave entry valve should be taken to mean the valve in first communication with the leader pipe, and the wave exit valve should be taken to mean the valve in first communication with the bell section.

In general in adjusting the downstroke and upstroke of the various valves it should be noted that the upstroke adjustment would, of course, affect the downstroke adjustment somewhat since the relationship of piston with respect to the stem 27 is permanently changed. Thus, to maintain exact alignment a compensating change should be made in set screw 38 when an upstroke adjustment has been made. Also in the adjustment procedure the downstroke adjustment is last to, in any case, allow effective compensation.

Also, although in the preferred embodiment continuous adjustment in the case of the upstroke is provided by the lock nut 36 in conjunction with the spring retainer 32, an equivalent construction may be substituted. For example, the retainer 32 could be slotted and a set screw threaded in the slot for widening the slot to provide a secure and permanent adjustment.

In conclusion, an improved valve instrument has been provided in which the downstroke and upstroke may be continuously adjusted to provide for port alignment which results in improved playing response. In addition, a method or technique is provided for achieving this improved response.

What is claimed is:

1. A valve type musical instrument having at least one valve and a movable piston with a predetermined upstroke and downstroke comprising: mechanically adjustable means associated with each of the valves of said instrument for continuous adjustment of said upstroke and downstroke, and means for locking said adjustable means in a selected adjustment.

2. An instrument as in claim 1 where said mechanical means provides for independent adjustment with respect to upstroke and downstroke.

3. An instrument as in claim 1 where each of said valves includes a sleeve in which said piston reciprocates said sleeve and piston having ports which are in nominal alignment on the upstroke and downstroke, said piston having threaded into its upper extremity an internal screw thread into which male screw thread means is fitted said male means having a stem extending therefrom and having lock means thereon for fixing the male means in said upper extremity of said piston whereby said upstroke is adjusted.

4. An instrument as in claim 1 where the upper extremity of said stem is internally threaded and includes an interior adjustable set screw having an upper end, said valve including a button with a threaded extension and fitted into said internally threaded stem to abut said upper end whereby said downstroke is adjusted.

5. A method for improving the playing response of a valve type musical instrument having at least one valve coupled to the leader pipe and to the bell such valve having mechanically adjustable means for continuous adjustment of the upstroke and downstroke of the piston said method comprising the following steps: aligning the upstroke and downstroke of the piston of said valve in substantially exact alignment by adjustment of said mechanically adjustable means; locking said means in the selected adjustment; thereafter testing the upstroke playing response of said instrument; if such response is defective adjusting the upstroke of said piston to misalign said piston up to 10/1000 inch; thereafter testing the downstroke playing response of said instrument; if such response is defective adjusting the downstroke of said piston to misalign said piston in the range of 3/1000 to 10/1000 inch.

* * * * *